US005971101A

United States Patent [19]

Taggart

[11] Patent Number: 5,971,101

[45] Date of Patent: Oct. 26, 1999

[54] ADAPTABLE CARRIER APPARATUS

[76] Inventor: Victor Taggart, 6186 Yates Ct., Arvada, Colo. 80003

[21] Appl. No.: 08/829,388

[22] Filed: Mar. 31, 1997

[51] Int. Cl.[6] ..... E04G 1/00

[52] U.S. Cl. ..... 182/129; 206/373

[58] Field of Search ..... 182/120, 121, 182/122, 129; 206/373, 374, 376, 379; 248/210; 224/904

[56] References Cited

U.S. PATENT DOCUMENTS

| | | | |
|---|---|---|---|
| D. 315,797 | 3/1991 | Cagle | D25/68 |
| D. 355,062 | 1/1995 | Maire et al. | D32/53 |
| D. 376,454 | 12/1996 | Fierek et al. | D32/54 |
| 3,842,936 | 10/1974 | DeLuca | 182/129 |
| 4,261,435 | 4/1981 | Winter . | |
| 4,276,955 | 7/1981 | Hickman | 182/129 X |
| 4,310,134 | 1/1982 | Schopp et al. . | |
| 4,356,854 | 11/1982 | McGee . | |
| 4,480,810 | 11/1984 | Hall . | |
| 4,653,713 | 3/1987 | Hamilton | 182/129 X |
| 4,726,446 | 2/1988 | Perbix . | |
| 4,730,802 | 3/1988 | Chatham et al. | 182/129 X |
| 4,773,575 | 9/1988 | Cook . | |
| 4,966,321 | 10/1990 | Outlaw | 224/904 X |
| 5,337,933 | 8/1994 | Nunez | 224/904 X |
| 5,638,915 | 6/1997 | Hardy | 182/129 |
| 5,639,003 | 6/1997 | Utzinger, III | 224/904 X |
| 5,647,453 | 7/1997 | Cassells | 182/129 |
| 5,749,437 | 5/1998 | Weller | 182/129 |
| 5,813,530 | 9/1998 | Kornblatt | 182/129 X |

*Primary Examiner*—Daniel P. Stodola
*Assistant Examiner*—Richard M. Smith
*Attorney, Agent, or Firm*—Edwin H. Crabtree; Ramon L. Pizarro; Donald W. Margolis

[57] ABSTRACT

A tool and material carrier adaptable for use on a variety of platforms such as four and three legged step ladders, extension ladders, universal or hinged ladders, platform ladders, scaffolding and the like. The carrier is made of a foldable body which conforms to various platform deigns. A multiple strap system having quick lock and release connectors secures the carrier to the various platforms. The front of the body includes a multi-tiered system of pouches and holders for tools and materials. The rear of the body includes additonal pouches or holders. The carrier includes a holster for gun shaped tools. An electric cord holder provided with or separately from the carrier holds an electric cord close to the working elevation of the platform. The electic cord holder includes a foldable strap having two portions which are matable when the strap is folded to form an opening smaller than the head of an electric cord to secure the electric cord between the two portions. Modular task specific attachments to the carrier provide additional versatility such as an attachable mud pan and mud knive holder or an attachable butane torch holder.

18 Claims, 5 Drawing Sheets

Fig. 13
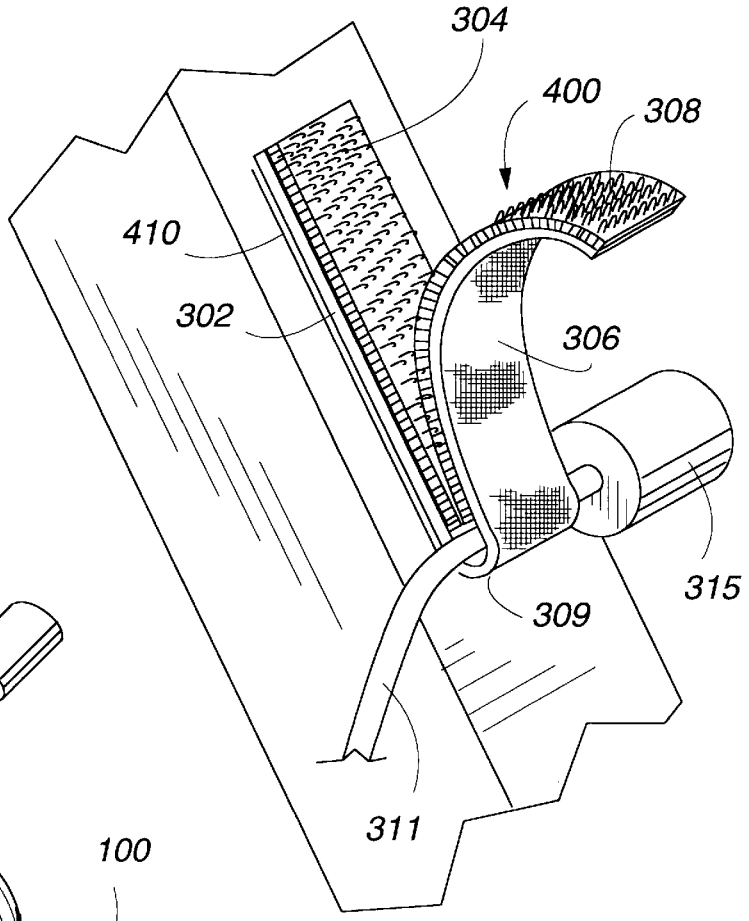
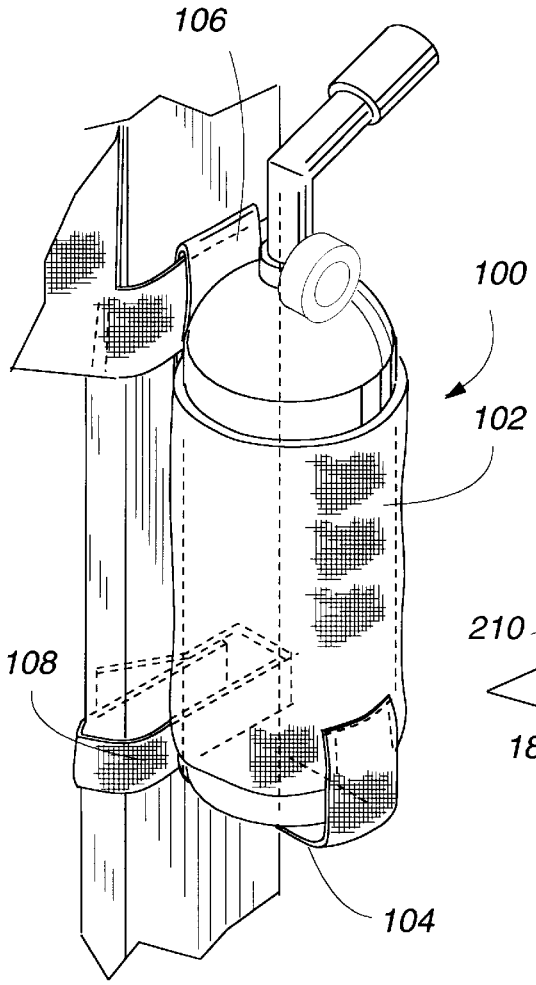
Fig. 11
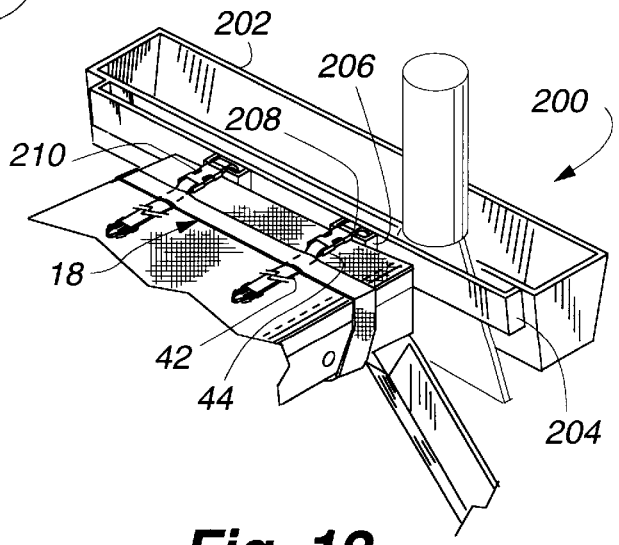
Fig. 12

ADAPTABLE CARRIER APPARATUS

BACKGROUND OF THE INVENTION

This invention relates generally to carrier devices, and more particularly, to a versatile and adaptable tool and material carrier for use on platforms such as ladders and the like.

The need for apparatus to allow a worker to securely hold tools and other necessary material when working at the top of an elevated platform such as a ladder is well established. Without such an apparatus, a worker can only rest a limited number of tools and materials on the top of the ladder. Such articles are easily dropped from the elevated position resulting in numerous injuries to the worker or another and such injuries can be serious or even fatal.

Such an apparatus creates time and cost savings and increases a worker's efficiency by organizing a great number of tools and materials so as to minimize or eliminate the need to climb up and down the platform to retrieve tools, time lost in looking for tools and materials, and time lost in picking up dropped materials or tools. Such an apparatus also creates cost savings in minimizing the number of broken or damaged tools by reducing or virtually eliminating the droppage rate.

One approach to solving the worker's problem has been to provide a tool belt to be worn by the worker while standing on top of his perch. However, such belts are cumbersome for climbing and are actually dangerous to the worker because of the inherent difficulties to the worker in maintaining balance while wearing such a belt. Additionally, the weight of all of the carried materials or tools is borne by the worker. Thus, it is advantageous for the weight of the materials and tools to be borne by the platform. Various designs have been adapted for such a purpose, but are typically limited to a particular type of platform type such as to an extension ladder or to a step ladder. Also, many of these designs are dangerous because they do not conform well to the ladder or otherwise provide rigid surfaces or obstructions against which a worker can trip or snag and fall off the platform.

For example, U.S. Pat. No. 4,356,854 discloses a work pouch adapted for use with a step ladder. It includes various rigid surfaces, including a rigid central portion which is not readily adapted for use on extension ladders and provides surfaces which could either hang up with the worker or cause the work pouch itself to tip off the ladder. The work pouch does not appear to be readily secured to a variety of ladder types. Likewise, U.S. Pat. No. D317,206 discloses a ladder bag tool holder which also is not particularly adapted for ready use with other ladder types. Similarly, U.S. Pat. No. D315,797 discloses a tool holder which can be used with an extension ladder but which is not readily suited for use on a step-ladder.

U.S. Pat. No. 4,480,810 discloses a ladder caddy somewhat adapted for use with both extension ladders and step ladders. The caddy creates large rigid obstructions relative to the user, which could allow the user to be knocked off balance by the caddy or the caddy to be knocked off the ladder by the user, either scenario creating potential for injury. Likewise, U.S. Pat. No. 4,773,535 discloses a rigid drape for draping over a sawhorse or rail but not particularly adapted for use with either a step ladder or with an extension ladder. The third embodiment disclosed in the patent discloses a tool carrier adapted for use with a step ladder but not with an extension ladder and which is relatively non-conforming to the step ladder.

Ladders come in a variety of designs and types such as four legged and three legged step ladders, extension ladders, hinged ladders, and others. It would be advantageous if a tool and material holder or carrier was adaptable to a variety of ladder or other platform types rather than a single or a very limited number. It would further be advantageous if such an apparatus was adapted to easily and quickly mount to or be removed from the ladder or platform. It would also be advantageous if the carrier could mount securely, conformably, and tautly to the ladder to minimize the potential for obstruction relative to the user or spillage from the carrier. It would also be advantageous if the carrier did not have to be removed from but could remain on the ladder and readily collapse therewith for storage. Relatedly, it would also be advantageous if the carrier apparatus could itself easily fold and store in a tool box or other small storage enclosure. From the standpoint of safety, if would advantageous if the carrier apparatus did not substantially add to the height or weight of the elevated platform and did not have any large rigid surfaces which could snag with the worker. It would additionally be advantageous if the carrier was adapted for use in multiple trades and could readily accept modular attachments for specific tasks or trades. It would further be advantageous if the carrier could hold an extension cord near the working level of the user on the platform.

SUMMARY OF THE INVENTION

Accordingly, the forementioned and other advantages are provided by a carrier embodying the principles of the present invention. In one embodiment, the carrier is provided with a fabric body having a central, front, and rear body portions. Each body portion has an associated cross strap extending across its width. Quick locking and releasing connectors are supported on each of the free ends of the cross straps to releasably connect the ends to form three closed loops. A provided D-slide on each of the loops allows the loops to be cinchable so that the loops may be cinched around various parts of the ladder.

In accordance with an important aspect of the present invention, the loops form a triple strapping system wherein one or more of the straps are used to secure and conform the carrier to a number of ladder types. For a four legged step ladder, the front strap is cinched around the front legs of the ladder, and the rear strap is cinched around the rear legs of the ladder. The center strap is cinched between the front and rear legs of the ladder around the top platform of the ladder. In this manner, each of the body portions is securely fastened to the ladder. The body and the pouches of the carrier are made of non-rigid materials so the carrier, while still attached to the step ladder, can be folded with the step ladder and stored with the ladder rather than having to be first removed from the ladder.

To mount the carrier to an extension ladder, the central body portion is draped over a rung of the ladder and the front and rear straps are cinched around the side rails of the ladder to conform and secure the carrier to the ladder. It is not necessary to connect the central strap to the ladder and the loop is merely cinched closed. In relatively the same manner, the carrier is mountable to a platform ladder with, again, the central body portion draped over the cross rail of the ladder and the front and rear straps secured around side legs or side rails of the ladder. Again, the central strap is merely cinched closed. The front and rear straps of the carrier are of a sufficient length to loop around legs or other ladder surfaces even if widely spaced apart.

On a universal ladder, where the rungs are on a shallow incline, it is sometimes preferable if the rear body portion is not secured to the ladder but is rather freely hanging from the ladder. In this application, both the center and rear straps are cinched closed and the front body portion is secured to the side rails of the ladder to secure it to the ladder. In this configuration, the central body portion merely rests against a rung of the ladder and the rear body portion hangs from the ladder.

The central portion is provided with flexible gripping straps to hold elongated articles such as T-squares, reciprocating saws, lumber, florescent bulbs and the like. The gripping straps are releasably connectable by provided mating male and female quick release connectors and likewise cinchable. A flexible multi-tiered holding system depends from said front body portion including first tier holding pouches, second tier holding pouches, and a third tier of tool and implement holding sleeves. The front body portion also includes additional holding loops and a size adjustable holster for holding gun shaped tools.

In accordance with another important aspect of the present invention, an electric cord holder is provided with the carrier to hold an electric cord at a working elevation on the platform. The electric cord holder is a flexible strap provided with mating swatches of hook and loop fasteners. An electric cord is run between the swatches which are fastened together to hold the electric cord in place. The electric cord holder can also be provided separately from the carrier with an adhesive backing layer to mount directly to a ladder or other platform.

Additional modular attachments can be connected to one of the quick release connectors of the gripping straps. One such attachment is used for drywalling and is provided with a mud pan and a rack for supporting a number of putty or tape knives. Other modular attachments can be attached to one of the cross straps such as a butane torch holder.

BRIEF DESCRIPTION OF THE DRAWINGS

Other objects, features, and advantages of the present invention will become more fully apparent from the following detailed description of several preferred embodiments, the appended claims and with reference to the accompanying drawings forming a part of the specification, wherein:

FIG. 11 is an orthogonal view illustrating a butane torch attachment used with the present invention.

FIG. 12 is an orthogonal view illustrating a mud pan attachment used with the present invention.

FIG. 13 is an orthogonal view of an electric cord holder directly attached to a ladder.

DETAILED DESCRIPTION OF PREFERRED EMBODIMENTS

FIGS. 1–10 illustrate by way of example one preferred embodiment of a multi-use carrier 10 embodying the principles of the present invention and an electric cord holder 300 as a feature of the carrier. The carrier 10 is adaptable to almost any ladder on the market including extension ladders, four-legged step ladders, three-legged step ladders, and universal or hinged ladders. FIGS. 11 and 12 illustrate two preferred attachments 100, 200 adapted for use with the carrier 10. FIG. 13 illustrates an electrical cord holder 400 provided separately from the carrier 10.

Figure 1:
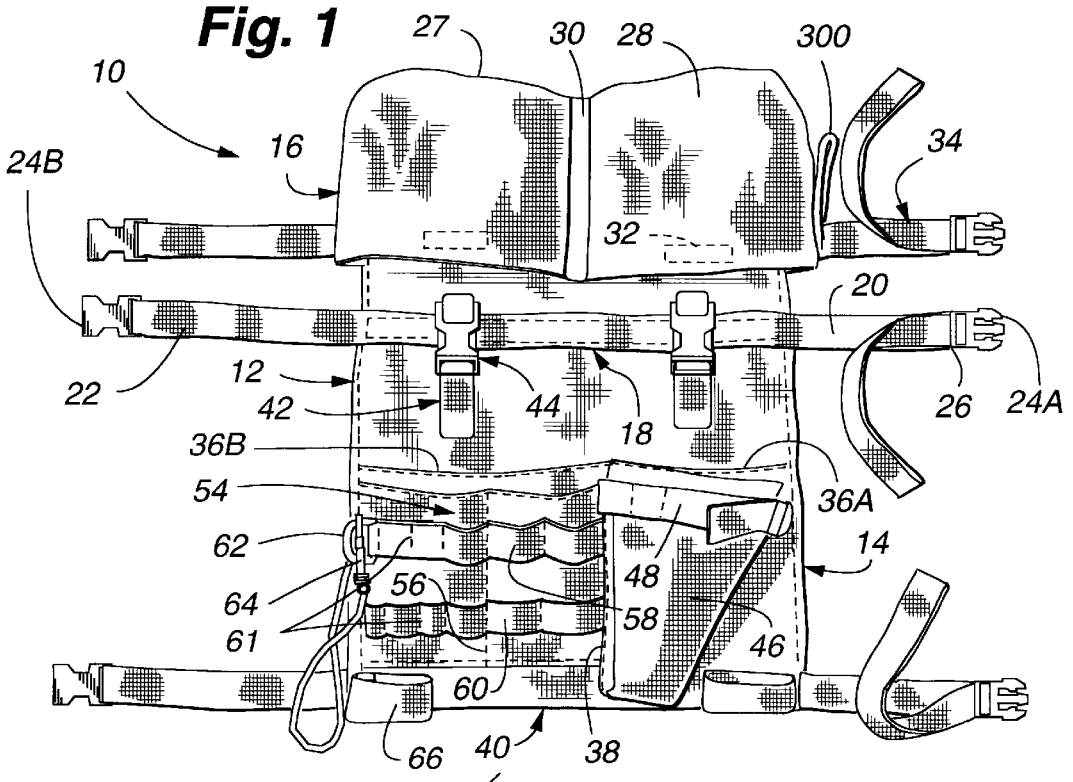
FIG. 1 is a plan view illustrating a carrier apparatus embodying the principles of the present invention.

As shown in FIG. 1, the body of the carrier 10 is comprised of three portions; a central body portion 12 and opposing front 14 and rear 16 body portions extending from opposite sides of the central portion. The body is unitary and is comprised of a suitable flexible and non-conductive material such as nylon cordura fabric. The fabric is conventionally coated for tear resistance and hydrophobic characteristics. For the purposes of this disclosure, the term "flexible" includes all materials sufficiently non-rigid to have the characteristic of conformability although the term principally refers to foldable materials.

In accordance with a principle aspect of the present invention, the carrier 10 is provided with a triple strap system. The system includes a first cross-strap 18 sewn laterally substantially across the entire width of central body portion 12. The cross-strap 18 is comprised of a nylon webbing or other suitable flexible and non-conductive material and terminates in free opposed first and second belt ends 20, 22. The belt end supports cooperating releasable locking or fastening means suitably provided by cooperating quick lock and quick release male and female buckles 24*a*, 24*b*, such as Fastex Model SR 1 cooperating buckles manufactured by ITW Nexus of Wood Dale, Ill. The male buckle 24*a* is conventionally secured to belt end 20 with an integral D-slide 26 to provide length adjustment to that belt end. Belt end 22 terminates in a permanent loop to which the female buckle 24*b* is conventionally attached. With the male and female buckles 24*a*, 24*b* coupled, the two belt ends 20, 22 form a cinchable belt loop for the purposes hereinafter described.

With continued reference to FIG. 1, the rear body portion 16 is provided with additional width at its distal end 27 and is folded to form a pair rear pouches 28 sewn to the rear portion and separated by a strip of nylon webbing 30 sewn across the width of the rear body portion 16. The rear pouches 28 have shape reinforcement stitching along their periphery and a folded bottom to alleviate flatness. Mateable swatches 32 of hook and loop fasteners are sewn adjacent to the top edge of each pouch and to a corresponding location (not shown) on the rear body portion 16 to close off the pouch openings when desired.

A second cross strap 34, similar to cross strap 18, is sewn laterally to the back of rear body portion 16 substantially across the entire width of the rear body portion. The second cross strap 34 has identical releasable fastening hardware as cross strap 18 to be likewise cinchable and, for purposes explained hereafter, is located closer to the openings of pouches 30 rather than the to bottom of the pouches.

The front portion 14 is folded over at its distal end to form a pair of front pouches 36*a*, 36*b* sewn to front portion 14 and separated by longitudinal stitching 38. A third cross strap 40, similar to cross strap 18, is sewn laterally substantially across the width of front portion 14 fold of the portion. The third cross strap 40 also has identical releasable fastening hardware as cross strap 18 and is likewise cinchable.

A pair of adjustable gripping straps 42 are sewn to central portion 12 beneath cross-strap 18. The gripping straps 42 are also comprised of nylon webbing or other suitable flexible and non-conductive material. Each gripping strap 42 terminates in opposed belt ends (not numbered) which each support mating releasable fastening means 44 such as provided by Fastex Model SR 3/4 cooperating male and female quick lock and quick release buckles manufactured by ITW Nexus of Wood Dale, Ill. The location of the holding straps 42 provides both additional securement to the central portion 12 and keeps a held object in a position of minimal interference to the worker, however, it will be understood that the holding straps can be secured at a number of locations on the central portion 12.

A variable size holster 46 is sewn onto pouches 36*a*. The holster 46 has an open top and bottom ends so that the tip of the drill, or other holstered tool, can extend through the bottom end if necessary. For additional strength, the holster 46 is a complete unit having its own inner and outer walls with the inner wall of the holster sewn to the outer wall of the pouch 36*a*. A size adjustment strap 48 is sewn at one end and at several additional locations to the holster 46 with the free end of the adjustment strap conventionally strung through a D-slide 50 attached to a permanent loop 52 sewn to pouch 36*a*. The adjustment strap 48 is cinchable to allow the holster to snugly accommodate various sized gun shaped power tools and such.

An additional nylon cordura fabric portion sewn along three sides of its periphery to the outer wall of pouch 36*b* forms a pair of second tier pouches 54 separated by stiching 56. A pair of lateral upper and lower nylon webbing bands 58, 60 are sewn to the fabric portion at spaced apart locations 61 to provide several separate corresponding sleeve pairs. The outermost sleeve of upper strip 56 is used to permanently hold a D-ring 62. A nylon string tied at one end to the D-ring 62 has a releasable clip 64 tied to its other end to provide a loop from which hangable objects, such as a roll of tape, may be readily held. The D-ring 62 also provides a lanyard to which a tool can be tied off to prevent it from falling to the ground if dropped. A permanent hanging loop 66 is sewn to the front portion 14 and to cross strap 40 at the outer bottom corner of pouches 36*a*, 36*b*. To help support an article hung in the loop, each hanging loop 66 is formed from nylon webbing thicker than that used elsewhere on the carrier or some other suitable flexible and non-conductive material. The functions of the above described features will be hereafter more fully described.

As shown in FIGS. 2–5, to mount the carrier 10 to a four-legged step ladder 70, the center portion 12 is draped over the top platform 71 of the step ladder and the cross strap 18 is connected underneath the top platform between the rear 73 and front 75 legs of the ladder and cinched to secure the central portion 12 to the top platform. In this manner, the central portion 12 is conformably secured to the top platform 71 or to any other platform surface having a sufficient surface area to support a portion of the central portion in a relatively flat orientation. The first cross strap 18 is located approximately ⅓ of the width of the central portion 12 from the rear portion 16 as it has been found that this placement optimally allows the first cross strap to readily fit between the front and rear legs 75, 73. This placement also holds the rear pouch 28 openings close to the top platform 17 for easy reach. The second cross strap 34 is connected around the rear legs 73 of the step ladder and cinched to conform and secure and the rear portion 16 against the rear legs. The third cross strap 40 is connected around the front legs 75 and cinched to conform and to secure the front portion 14 against the front legs. The height difference between the second 34 and third 40 cross straps along the longitudinal axis of the step ladder prevents interference between cross-straps when connecting or disconnecting the straps. While not shown, an optional longitudinal length adjustable strap could be provided, if desired, extending from the bottom of the nylon webbing 30 (which separates pouches 28) to wrap around or otherwise connect to a rear cross-support 77 of the step ladder to hold the rear body panel 16 longitudinally taut.

A similar procedure is employed to secure the carrier 10 to a three-legged ladder (not shown). The first cross stap 18 is again secured beneath the top platform of the ladder and the third cross strap 40 is secured around the front legs of the ladder. The rear body portion 16 rests against the rear third leg of the ladder, and the second cross strap 34 is also secured around the rear third leg of the ladder.

Figure 5:
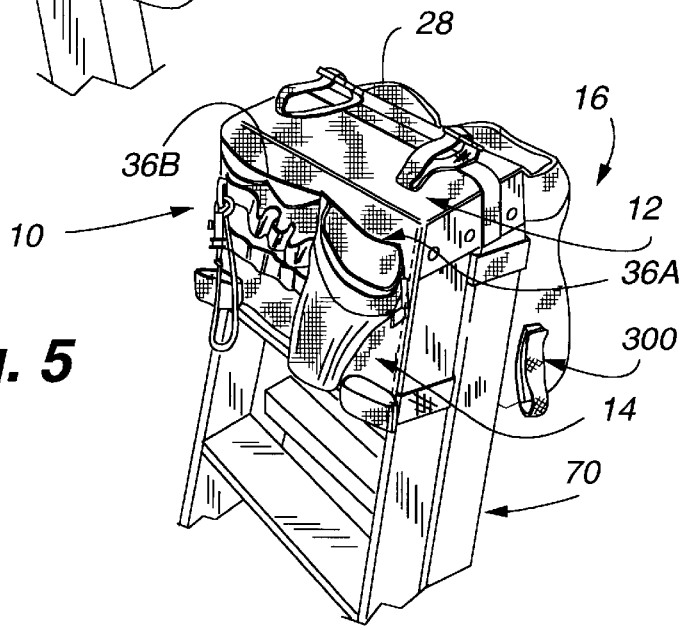
FIG. 5 is an opposite partial orthogonal view illustrating the carrier apparatus of FIG. 1 empty and folded for storage with the step ladder.

As shown in FIG. 5, because the body of the carrier 10 is made of flexible fabric, with the tools and other held materials removed, the carrier 10 may be kept on the step ladder 70 by the strapping system and will readily fold with the step ladder for storage therewith. If a user prefers not to keep the carrier 10 on the step ladder 70, the locked loops created by the three straps are quickly and readily disconnected and the carrier 10 can be folded and stored in a small area.

Figure 6:
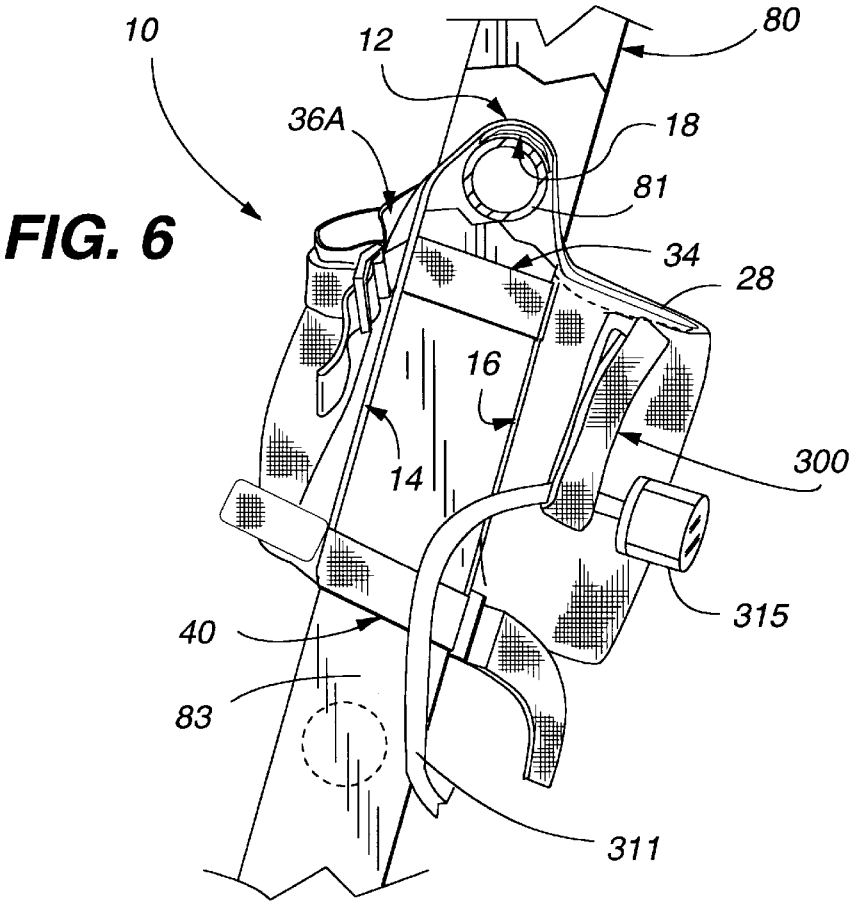
FIG. 6 is a partial side elevation view illustrating the carrier apparatus of FIG. 1 secured to an extension ladder with a portion of the ladder cut away.
Figure 9:
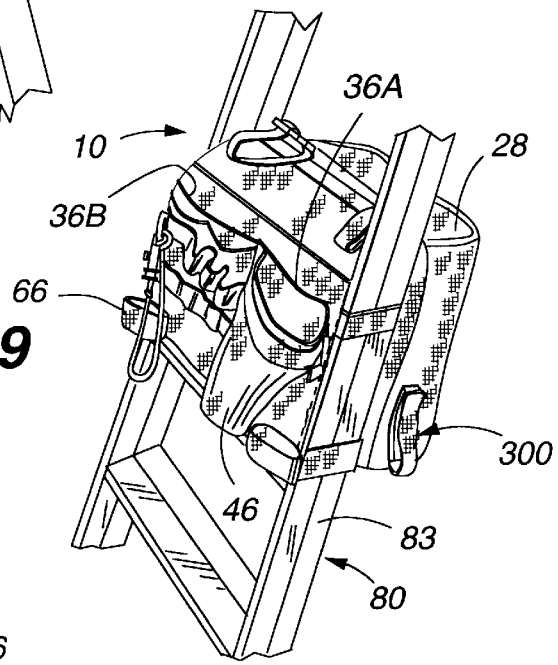
FIG. 9 is an orthogonal view illustrating the carrier apparatus of FIG. 1 secured to an extension ladder.
Figure 10:
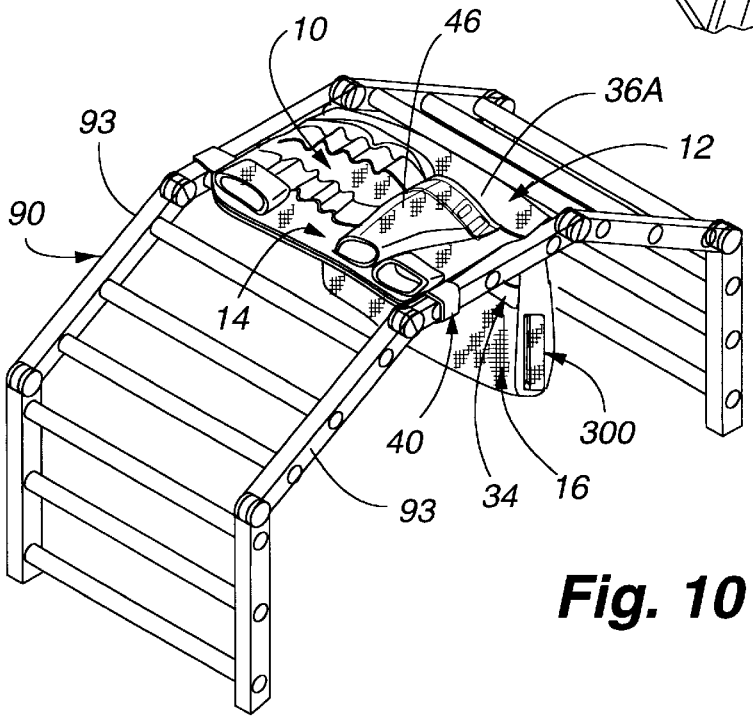
FIG. 10 is an orthogonal view illustrating the carrier apparatus of FIG. 1 secured to a universal ladder. a mud pan adapted for use with a carrier apparatus of the present invention.

As shown in FIGS. 6 and 9, the carrier 10 can also readily used with an extension type ladder 80. For this configuration, the width of the central portion 12 may be reduced to more readily conform to the rung width of the ladder, if desirable, by simply connecting the first cross strap 18 to itself and cinching the cross strap. The cross strap 18 is not secured around any part of the ladder in this configuration; the central portion 12 is simply draped over the ladder rung 81 and the second and third cross straps 34, 40 are connected around the side rails 83 of the ladder and cinched to conform and secure the rear and front portions 16,14 to the extension ladder.

Figure 8:
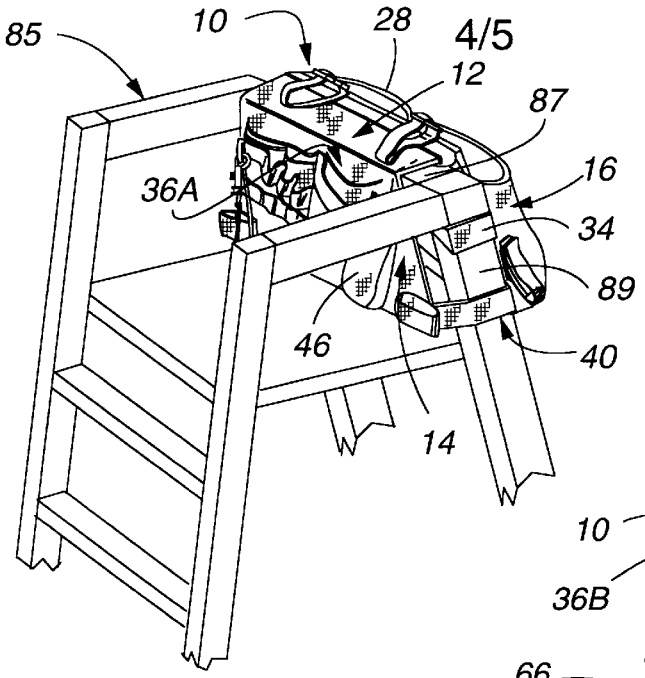
FIG. 8 is an orthogonal view illustrating the carrier apparatus of FIG. 1 secured to a platform ladder.

As shown in FIG. 8, the carrier 10 may be secured to a platform ladder 85 in similar manner as to the extension ladder 80. The center portion 12 is draped over the cross rail 87 of the platform ladder with the first strap 18 simply connected to itself and not secured to any portion of the ladder 80. The second and third cross straps 34, 40 are connected around the legs 89 of the platform ladder and cinched to conform the carrier 10 to the ladder.

Figure 7:
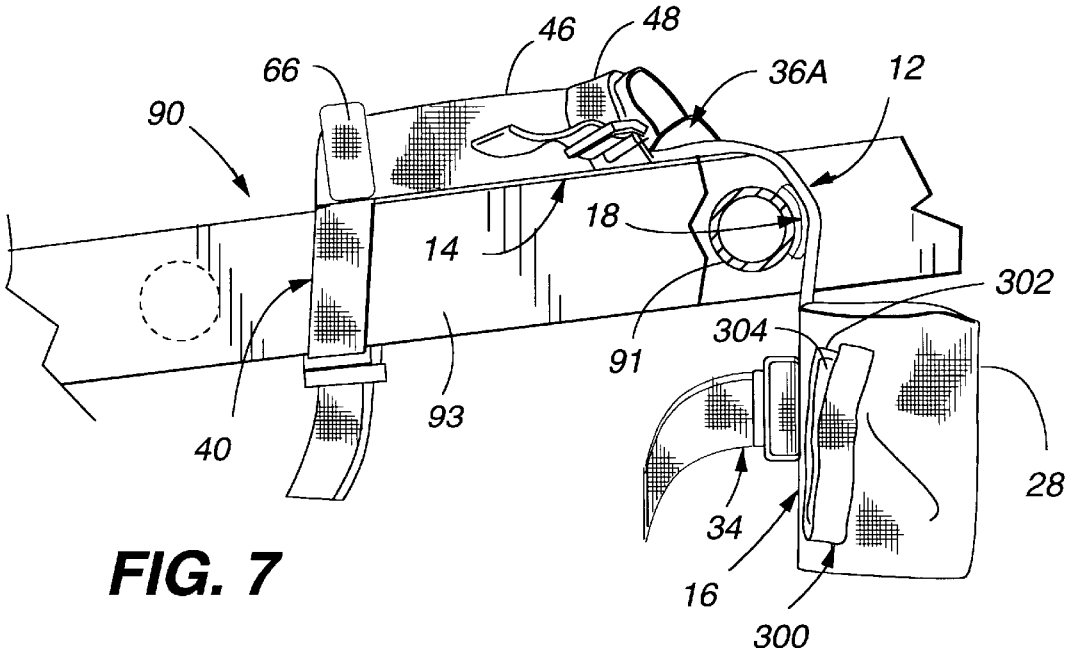
FIG. 7 is a partial side elevation view illustrating the carrier apparatus of FIG. 1 secured to a universal ladder with a portion of the ladder cut away.

The carrier 10 may be used in yet another mode on a universal (i.e., hinged) ladder 90 or in other cases where the ladder at a shallow incline. As seen in FIG. 7, only cross strap 40 is connected around the side rails 93 of the ladder and cinched to conform and secure the front portion 14 to the ladder 90. The rear portion 16 is allowed to simply by gravity and the materials contained in pouches 30 safely remain in the pouches. In this mode, neither first cross strap 18 nor second cross strap 34 are secured around any element of the ladder and the center portion 12 merely rests against the rung 91. Once again, first cross strap 18 may be used to narrow the width of center portion 12 if necessary. In both FIGS. 6 and 7, the first cross-strap 18 is only schematically depicted (sandwiched between the rung and the center portion 12) for clarity.

Figure 4:
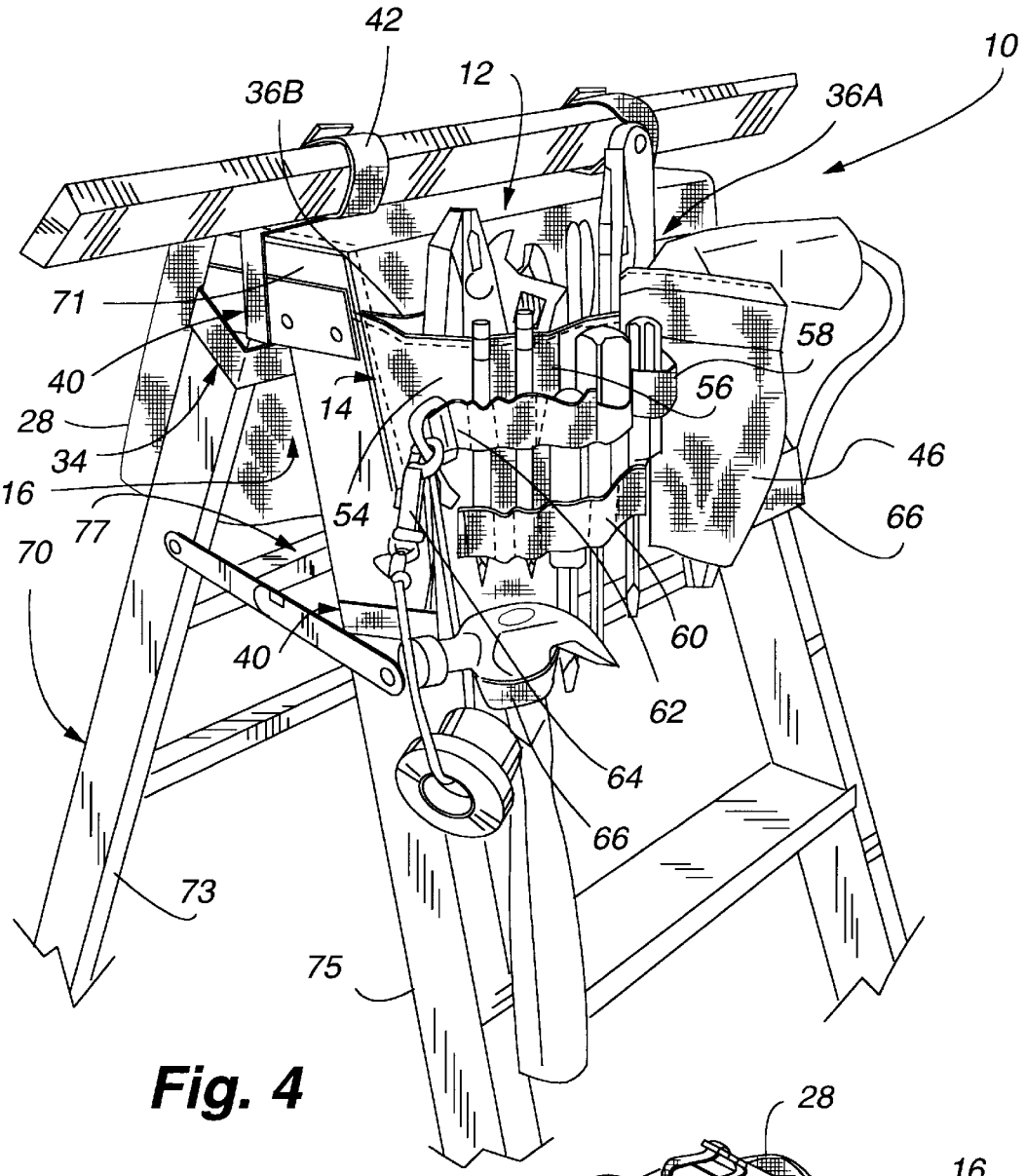
FIG. 4 is a partial orthogonal view illustrating the carrier apparatus of FIG. 1 secured to a step ladder and holding tools and materials.

As best seen in FIG. 4, the central portion 12 is sized to substantially but not fully cover the top platform 71 of a typical step ladder 70. Since all platforms are not uniform in size, even if the central portion does extend past the edges of a particular top platform it does not create any snagging surfaces against which a worker can catch.

Figure 2:
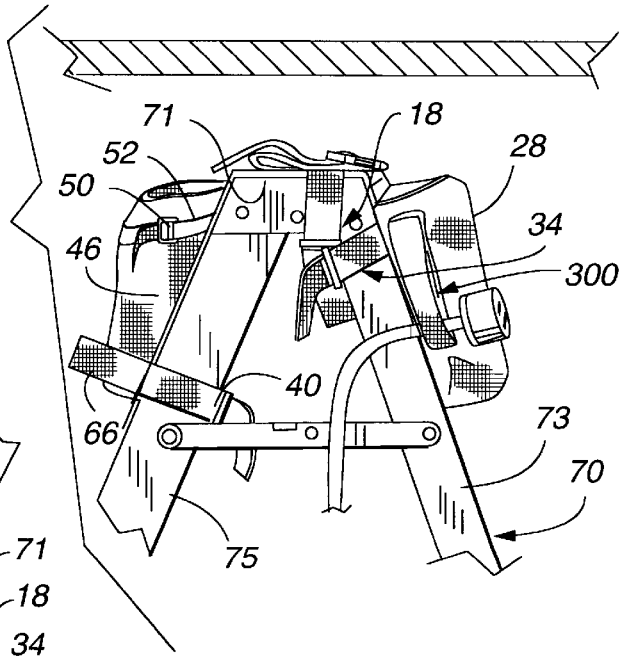
FIG. 2 is a partial side elevational view of the carrier apparatus of FIG. 1 secured to a step ladder.
Figure 3:
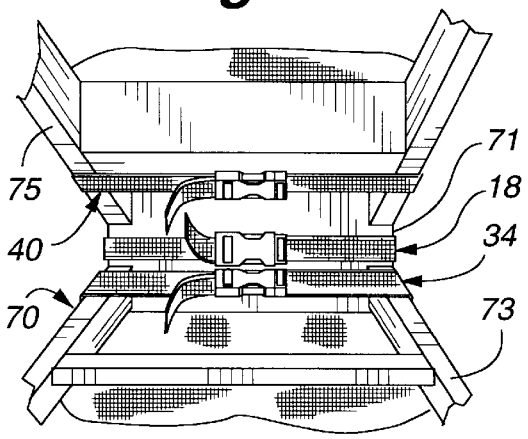
FIG. 3 is a partial bottom view illustrating the carrier apparatus of FIG. 1 secured to a step ladder.

The adjustable gripping straps 42 are cinchable and are provided to hold objects larger than the size of the top platform of the step ladder such as flourescent bulbs, long pieces of wood (as illustrated), large levels, pipes, large portable tools such as a reciprocating saw, and the like. As best seen in FIG. 2, the adjustable gripping straps 42 can be cinched substantially closed when not in use and in any event do not substantially add to the height of the step ladder or create any large rigid surfaces against which a worker is likely to catch and be thrown off balance. The female connector is on the belt end of each gripping strap 42 more adjacent to the rear body portion 16. Because of this orientation, when the male connector is snapped into place, the strap 42 is cinched by pulling the belt end supporting the male connector towards the user. This facilitates the use by gripping straps 42 and allows the user to more readily maintain balance while cinching the loops. While not illustrated, it will be appreciated that the gripping straps 42 can also readily be cross-tied to form a handle for the carrier if desired. In this configuration, the male connector of one gripping strap engages the female connector of the other gripping strap.

Each rear pouch 28 is used to carry screws, nails, pipe fittings, hardware or other materials, or selected tools. The first cross strap 18 is located sufficiently close to the pouch openings so that the openings are positioned near the top platform 71 of the step ladder 70 for easy reach when the carrier 10 is mounted thereto. This also minimizes the potential for spillage of articles from the pouches 28. The cross strap 34 is also located near the top of the pouches 28 rather than near the bottom so that when the cross strap 34 is cinched around the leg 73, the rear body portion 16 is held taught across the sides 73 of the ladder near the openings of the pouches 28 minimizing the droop of the pouch openings.

The front pouches 36*a*, 36*b* are sized to accommodate such tools as tape measures, chalk boxes, and the like. The second tier pouches 54 are sized to hold tools such as pliers, crescent wrenches, ratchets, utility knives and the like. A third tier is provided by the upper and lower bands 58, 60 which are stitched at spaced locations 61 along their length to define opposed sleeves. Some of the upper band 58 sleeves are sized to hold the handles of such tools as tin snips, screw drivers, needle nose pliers and the like with the corresponding lower band 60 sleeve sized to hold the working end or shaft of the tool. In use, the heavier of such tools may be held in the sleeves nearest to the holster 46. Other upper and corresponding lower sleeves are sized so as to snugly hold a writing implement. The loops 66 are sized to accommodate such hanging objects as a pipe wrench, hammer, flashlight, and the like and are positioned to keep the hanging object in a non-obstructive location relative to the user. While any number of configurations may be used, the above described exemplary multi-tiered configuration accommodates a broad range of crafts without creating undue weight or size to the carrier 10.

As shown in FIGS. 11 and 12, various attachments can be used with the carrier 10 to provide additional versatility. A butane torch attachment 100 is shown in FIG. 11. A sleeve 102 of nylon cordura holds the butane torch. A strip of nylon webbing 104 sewn to opposed sides of the sleeve extends across the distal end to support the bottle. The webbing 104 also extends up one side of the sleeve, sewn thereto, and terminates in a loop 106 adjacent the top of sleeve 102. The cross strap 40, for example, is run through the loop 106 to attach the bottle holder 100 to the carrier 10. A second nylon webbing strip 108 is sewn to a portion of webbing strip 104 adjacent the distal end of sleeve 72. The strip 108 has a swatch (not numbered) of loop fasteners sewn to its outside substantially along its entire length and a swatch (not numbered) of mating hook fasteners sewn to its inside along a portion of its length. The second nylon webbing strip 108 is secured around the leg of a ladder to tightly secure the bottle holder 100 to the ladder. It will be appreciated that other releasable fastening means could also be used.

Alternatively, various apparati can be attached to the carrier 10 by directly engaging one or more connectors 44 of holding straps 42. FIG. 12 shows a mud pan attachment 200. The mud pan attachment 200 includes a mud pan 202 from which a rack 204 extends and defines a slot adjacent to the mud pan. The slot is sized so that the rack can support applicators such as spackling or taping knives by their handles with the blades of the knives extending through the slot. A pair of open top strap retainers 206 extend from the rack 204. A pair of nylon webbing straps 208 extend from the mud pan 202 through the strap retainers and out of the open tops of the retainers 206. Each of the straps 208 terminates with a male connector 210 mateable with the previously described female connector 44 of gripping strap 42. In this manner, a variety of specialized apparati can be attached to the carrier 10.

A common problem for a craftsman working on an elevated platform is that power cord connections, such as the connection between the power cord of an electrical tool and an extension cord, can often interfere with the worker. Often, the connection may be at or near the worker's feet or in some other place where it could snag with or trip the worker. In many positions, the connection between power cords is difficult to reach, for example, when unplugging one power tool from the extension cord and plugging in a second power tool to the extension cord. Also, the connection is frequently liable to accidently disconnect as when being pulled up by the craftsman. If the connection between the electric tool power cord and the extension cord is not located close to the top of the ladder, the worker is not able to fully utilize the power cord length and may accidentally unplug the tool's power cord from the extension cord while using the tool. Additionally, certain electric cords have plastic insulating heads which may break or crack on impact from falling from an elevated position. This creates a safety problem in that the breakage can cause a potential for exposure to electrical shock. Therefore, a need exists for an apparatus which will keep the electrical connection close to elevation of the worker and secure against the ladder or platform. Referring to FIGS. 2, 6, and 13, such an apparatus is provided by a distinct aspect of the present invention in the form of an electric cord holder 300. The electric cord holder 300 is comprised of a strip of nylon webbing or other suitable non-conductive, non-rigid material. A first portion 302 of the strip is sewn to a side wall of a pouch 28. It will be understood that other locations may also be used; however, this location allows the extension cord 311 to be held in a convenient and non-obstructive position relative to the worker. This also positions the electric cord holder 300 close to the holster 46. A first swatch 304 of hook (or loop) fasteners, or some other suitable fastening means, is sewn to the first portion 302. A free second portion 306 has sewn thereto a second swatch 308 of loop (or hook) fasteners mateable with the first swatch 304. The swatches 304, 308 run substantially along the length of their respective portions 302, 306. A third portion 309 of the strip between the first and second portions 302, 306 has nothing sewn thereon and acts a flexible hinge to allow the first and second portions to mate. The extension cord 311 is held between the first and second portions 302, 304 by fastening the portions together to secure the cord in place. The head 315 of the cord 311 further helps to prevent the cord from slipping from the holder 300. As shown in FIG. 13, an alternate form of the holder 400 is provided with an adhesive backing layer 410 such as double sided tape or other fastening means to secure the holder 400 to the carrier 10 or directly to ladder or platform. It will be appreciated that the holder also provides no rigid surfaces which could snag with a worker. It will also be appreciated that ladders could be directly provided with such a holder 400.

From the above, it will be understood that the configuration of the carrier 10 and strapping system provide a versatile multi-purpose carrier which may be readily and secured to and removed from a variety of ladder types. It will also be appreciated that the carrier 10 is capable of being stored with or semi-permanently attached to a ladder and is snugly fit to a variety of ladders with minimal movement of tools and materials and minimal interference with or obstructions to the worker. It will also be appreciated that the design and the use of soft materials also provides the safety and versatility here shown. It will also be appreciated that a beneficial electric cord holder is provided both as an integral and distinct element of the carrier.

Although only a few exemplary embodiments of this invention have been described in detail above, those skilled in the art will readily appreciate that many modifications are possible in the exemplary embodiments without materially departing from the novel teachings and advantages of this invention. For example, substantial versatility could be achieved with a double strapping system in which the first cross strap 18 is excluded. It will also be understood that many configurations of means for holding tools and materials could be employed. Accordingly, all such modifications are intended to be included within the scope of this invention as defined in the following claims. In the claims, means-plus-function clauses are intended to cover the structures described here as performing the recited function and not only structural equivalents but also equivalent structures. Thus, it should be understood that this invention is not to be limited to the exact forms disclosed and many changes in detail and construction of the invention may be made without departing from the spirit thereof.

I claim:

1. A carrier apparatus adapted for mounting on top of a four-legged step ladder, the step ladder having a top platform connected to front legs and rear legs, the apparatus comprising:

a flexible body having a central body portion and a front and a rear body portion extending respectively from opposite sides of said central body portion, said central body portion adapted for receipt on top of the top platform of the ladder, said front body portion adapted for receipt next to a portion of the front legs of the ladder, said rear body portion adapted for receipt next to a portion of the rear legs of the ladder;

a first cross strap depending from said central body portion and terminating in opposed free ends, said first cross strap extending completely across said central body portion parallel to the opposite sides of said central body portion and offset from a center of said central body portion, said first cross strap adapted for receipt around sides and a bottom portion of the top platform and adapted to be disposed next to the rear legs of the ladder;

first releasably fastening means for releasably connecting said opposed free ends of said first strap;

a second cross strap depending from said rear body portion and terminating in opposed free ends, said second cross strap adapted for receipt around a portion of the rear legs of the ladder;

second releasably fastening means for releasably connecting said opposed free ends of said second strap;

a third cross strap depending from said front body portion and terminating in opposed free ends, said third cross strap adapted for receipt around a portion of the front legs of the ladder;

third releasably fastening means for releasably connecting said opposed free ends of said third strap; and at least one holding means depending from said flexible body and adapted for holding tools and materials therein.

2. The carrier apparatus as described in claim 1 wherein said releasable fastener means include a pair of releasably locking male and female connectors.

3. The carrier apparatus as described in claim 1 further including a gripping means extending outwardly from said central body adapted for gripping an object to said central body portion.

4. The carrier apparatus as described in claim 3 wherein said gripping means includes at least one selectively closeable variable length loop.

5. The carrier apparatus as described in claim 1 further including a flexible multi-tiered holding system attached to and extending outwardly from said front body portion.

6. The carrier apparatus as described in claim 5 wherein said multi-tiered holding system includes at least one first tier holding pouch, at least one second tier holding pouch attached to said first tier holding pouch and at least one sleeve attached to said second tier holding pouch.

7. The carrier apparatus as described in claim 1 further including a holding loop at a distal corner of said front body portion and supported by said third cross strap.

8. The carrier apparatus as described in claim 1 further including a flexible holster attached to said front body portion, said holster having an open top and an open bottom, said holster tapered inwardly from the open top to the open bottom.

9. The carrier apparatus as described in claim 8 further including means for adjusting an opening size in the open top in said holster.

10. The carrier apparatus as described in claim 1 further including an electric cord holder attached to said rear body portion, said cord holder having a strap with a first strap portion and a second strap portion foldable to mate with said first strap portion and releasable attachment means for mating said first strap portion with said second strap portion and forming an opening smaller than the head of an electric cord.

11. The carrier apparatus as described in claim 1 wherein said third cross strap is attached to a bottom of said front body portion adapted to prevent the torquing or twisting of the front body portion on the front legs of the ladder when tools and materials are received thereon.

12. A carrier apparatus adapted for mounting on top of a four-legged step ladder, the step ladder having a top platform connected to front legs and rear legs, the apparatus comprising:

a flexible body having a central body portion and a front and a rear body portion extending respectively from opposite sides of said central body portion, said central body portion adapted for receipt on top of the top platform of the ladder, the front body portion adapted for receipt next to a portion of the front legs of the ladder, said rear body portion adapted for receipt next to a portion of the rear legs of the ladder;

a first cross strap depending from said central body portion and terminating in opposed free ends, said first cross strap extending across said central body portion parallel to the opposite sides of said central body portion and offset from a center of said central body portion, said first strap adapted for receipt around sides and a bottom portion of the top platform and disposed next to the rear legs of the ladder;

first releasably fastening means for releasably connecting said opposed free ends of said first strap;

a second cross strap depending from said rear body portion and terminating in opposed free ends, said second cross strap adapted for receipt around a portion of the rear legs of the ladder;

second releasably fastening means for releasably connecting said opposed free ends of said second strap;

a third cross strap depending from said front body portion and terminating in opposed free ends, said third cross strap adapted for receipt around a portion of the front legs of the ladder, said third cross strap attached to a bottom of said front body portion for preventing torquing and twisting of said front body portion, said third cross strap adapted for receipt around a portion of the front legs of the ladder;

third releasably fastening means for releasably connecting said opposed free ends of said third strap; and at least one holding means depending from said flexible body and adapted for holding tools and materials therein.

13. The carrier apparatus as described in claim 12 wherein said releasable fastener means include a pair of releasably locking male and female connectors.

14. The carrier apparatus as described in claim 12 further including a flexible multi-tiered holding system attached to and extending outwardly from said front body portion.

15. The carrier apparatus as described in claim 14 wherein said multi-tiered holding system includes at least one first tier holding pouch, at least one second tier holding pouch attached to said first tier holding pouch and at least one sleeve attached to said second tier holding pouch.

16. The carrier apparatus as described in claim 12 further including a selectively closeable variable length loop, said loop including a flexible strap having opposed free ends, releasable fastening means for releasably connecting the opposed free ends to form said loop and means for adjusting the length of the loop.

17. The carrier apparatus as described in claim 12 further including an electric cord holder attached to said rear body portion, said cord holder having a strap with a first strap portion and a second strap portion foldable to mate with said first strap portion and releasable attachment means for mating said first strap portion with said second strap portion and forming an opening smaller than the head of an electric cord.

18. The carrier apparatus as described in claim 12 further including a holding loop attached to said flexible body.

* * * * *